US007351032B2

(12) United States Patent
Horng et al.

(10) Patent No.: US 7,351,032 B2
(45) Date of Patent: Apr. 1, 2008

(54) HEAT DISSIPATING FAN WITH AN AIRFLOW GUIDING STRUCTURE

(75) Inventors: Alex Horng, Kaohsiung (TW); Yin-Rong Hong, Kaohsiung (TW); Ching-Sheng Hong, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 0 days.

(21) Appl. No.: 10/714,970

(22) Filed: Nov. 18, 2003

(65) Prior Publication Data

US 2005/0089402 A1 Apr. 28, 2005

(51) Int. Cl.

| | |
|---|---|
| ***F04D 29/52*** | (2006.01) |
| ***F04D 29/54*** | (2006.01) |
| ***F04D 29/70*** | (2006.01) |
| ***F04D 29/40*** | (2006.01) |

(52) U.S. Cl. ..... 415/213.1; 415/223

(58) Field of Classification Search ..... 415/175–178, 415/213.1, 214.1, 121.2, 185, 186, 208.2, 415/208.3, 208.5, 211.2, 220, 222, 223, 191, 415/192; 416/247 R; 361/695–697
See application file for complete search history.

(56) References Cited

U.S. PATENT DOCUMENTS

| | | | | |
|---|---|---|---|---|
| 5,522,700 | A | 6/1996 | Hong | |
| 5,559,674 | A * | 9/1996 | Katsui | 361/697 |
| 5,582,506 | A | 12/1996 | Hong | |
| 5,584,339 | A | 12/1996 | Hong | |
| 5,896,917 | A * | 4/1999 | Lemont et al. | 165/80.3 |
| 6,183,196 | B1 * | 2/2001 | Fujinaka | 415/208.5 |
| 6,343,014 | B1 * | 1/2002 | Lin | 361/697 |
| 6,457,949 | B1 * | 10/2002 | Bendikas et al. | 415/193 |
| 6,524,067 | B1 * | 2/2003 | Chen et al. | 415/208.5 |
| 6,637,502 | B1 * | 10/2003 | North et al. | 361/697 |
| 6,712,130 | B2 * | 3/2004 | Lin | 361/697 |
| 6,726,455 | B2 * | 4/2004 | Horng et al. | 361/697 |
| 6,817,939 | B2 * | 11/2004 | Gan et al. | 361/695 |
| 6,827,549 | B1 * | 12/2004 | Horng et al. | 415/213.1 |
| 7,063,504 | B2 * | 6/2006 | Huang et al. | 415/165 |
| 2002/0168277 | A1 * | 11/2002 | Hsieh | 417/423.5 |
| 2004/0201961 | A1 * | 10/2004 | Ko et al. | 361/695 |

FOREIGN PATENT DOCUMENTS

| | | |
|---|---|---|
| TW | 540641 | 7/2003 |

* cited by examiner

*Primary Examiner*—Edward K. Look
*Assistant Examiner*—Nathan Wiehe
(74) *Attorney, Agent, or Firm*—Bacon & Thomas, PLLC

(57) ABSTRACT

A heat dissipating fan includes a cover plate having an air inlet and a base, an impeller mounted to the base and having a plurality of blades, and an air guiding member having an air passageway and an air outlet. A portion of an axial height of the respective blade is received in the air passageway of the air guiding member. Side inlets are defined between the cover plate and the air guiding member. Air intake occurs simultaneously in the air inlet and in the side inlets when the impeller turns, driving airflow to exit the air outlet in a predetermined direction.

18 Claims, 10 Drawing Sheets

HEAT DISSIPATING FAN WITH AN AIRFLOW GUIDING STRUCTURE

BACKGROUND OF THE INVENTION

1. Field of the Invention

The present invention relates to a heat dissipating fan with an airflow guiding structure.

2. Description of Related Art

A typical conventional heat dissipating fan is disclosed in, e.g., U.S. Pat. Nos. 5,522,700, 5,584,339 and 5,582,506 and includes a cover plate, an impeller, and a heat dissipating plate. The cover plate includes an air inlet and a base, and the impeller is mounted to an upper side or an underside of the cover pate. The heat dissipating plate is mounted to an object to be dissipated, such as a central processing unit. In operation, the impeller forces the air from the inlet to move toward the heat dissipating plate for dissipating heat.

The airflow can, however, only move outward along the extending direction of the fins on the heat dissipating plate, and the heat dissipation effect can only be achieved through the heat dissipating plate. The heat dissipating fan could neither guide and expel the airflow directly downward nor directly provide a heat dissipating effect for an object located right below the heat dissipating fan. Further, a fan unit consisting of a cover plate and an impeller must be used with a heat dissipating plate. Application of the fan unit consisting of a cover plate and an impeller is limited, and it is difficult to reduce the cost for manufacturing various types of heat dissipating fans. Further, the air inlet amount could not be effectively increased, as the impeller can only drive air in via the air inlet of the cover plate. Further, the wind pressure could not be increased. As a result, the application of the heat dissipating fan is limited, and the heat dissipating efficiency is poor.

Another typical conventional heat dissipating fan disclosed in, e.g., Taiwan Utility Model Publication No. 540641, is an axial fan including a casing and an impeller. The impeller is rotatably mounted on a base provided on an air outlet side of the casing. On an air inlet side of the casing, a plurality of radial inlets extend from an air inlet toward a periphery of the casing. An air gain guiding plate extends radially outward from the respective blade on the impeller and aligns with the respective radial inlet, thereby increasing the air inlet amount.

However, the impeller must be mounted on the base of the casing such that the casing of a certain specification can only be used with an impeller of a corresponding specification, resulting in a limited application of the casing and the impeller and thus failing to effectively reduce the cost for manufacturing various types of heat dissipating fans.

Further, since the respective air gain guiding plates can only drive the air to pass through the respective radial inlets and since the air is driven inward and downward by the respective air gain guiding plates, turbulence is generated in a joint area between the periphery of the respective radial inlet and an inner periphery of the casing. As a result, provision of the air gain guiding plates results in wind noise. Further, the axial flow fan could not increase the wind pressure. Application of the axial flow fan is limited and the heat dissipating fan is unsatisfactory.

OBJECTS OF THE INVENTION

An object of the present invention is to provide a heat dissipating fan with an airflow guiding structure for guiding airflow and for improving the overall heat dissipating efficiency.

Another object of the present invention is to provide a heat dissipating fan with an airflow guiding structure to increase an overall area for the incoming air, thereby increasing the air inlet amount and thus improving the overall heat dissipating efficiency.

A further object of the present invention is to provide a heat dissipating fan with an airflow guiding structure to increase the wind pressure and thus improve the overall heat dissipating efficiency.

SUMMARY OF THE INVENTION

In accordance with an aspect of the invention, a heat dissipating fan includes a cover plate having an air inlet and a base, an impeller mounted to the base and having a plurality of blades, and an air guiding member having an air passageway and an air outlet. A portion of an axial height of the respective blades, as well as a lower portion of the axial length of the hub portion, is received in a first section of the air passageway of the air guiding member defined between the air inlet and a middle point of the air guiding number so as to reduce an overall thickness of the combination of the fan unit and the air guiding member, and to remain a second section of the air passageway of the air guiding member defined between the middle point and the outlet of the air guiding member below the hub portion of the fan unit. Auxiliary side inlets are defined between the cover plate and the air guiding member. Air intake occurs simultaneously in the air inlet and in the side inlets when the impeller turns, the side wall of the air guiding member confining air in the second section of the air passageway to pass through near regions below the hub portion of the fan unit and then to exit the air outlet in a predetermined direction. The air guiding member includes a sidewall, and the air passageway is defined between a first end and a second end of the sidewall. The first end of the air guiding member connects to the cover plate in a stacked relationship, and the air outlet of the air guiding member is proximate to the second end of the air guiding member beyond the fan unit such that the air outlet disposed at the second end can be expanded.

Other objects, advantages and novel features of this invention will become more apparent from the following detailed description when taken in conjunction with the accompanying drawings.

DETAILED DESCRIPTION OF THE PREFERRED EMBODIMENTS

Figure 1:
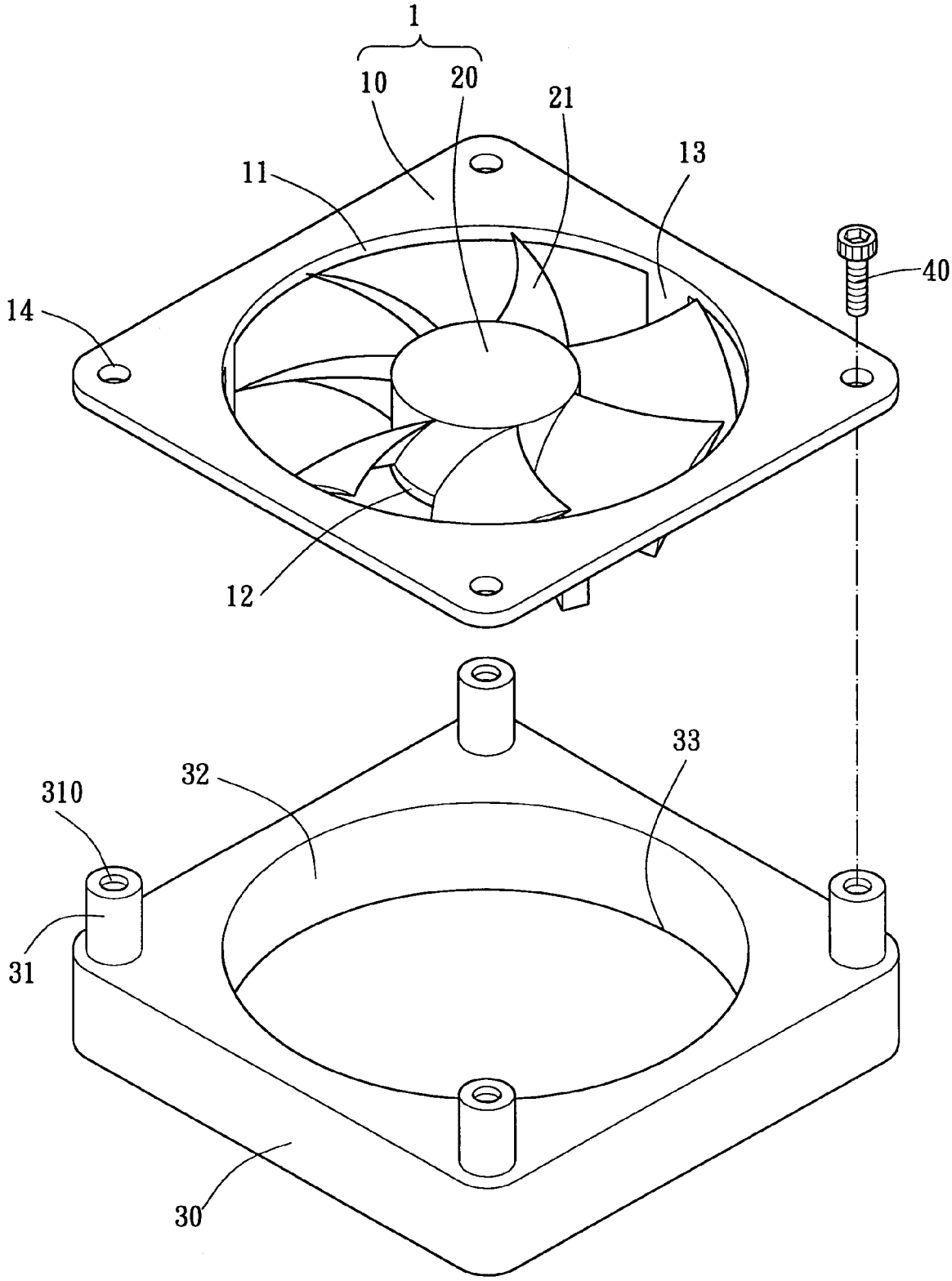
FIG. 1 is an exploded perspective view of a first embodiment of a heat dissipating fan in accordance with the present invention.
Figure 2:
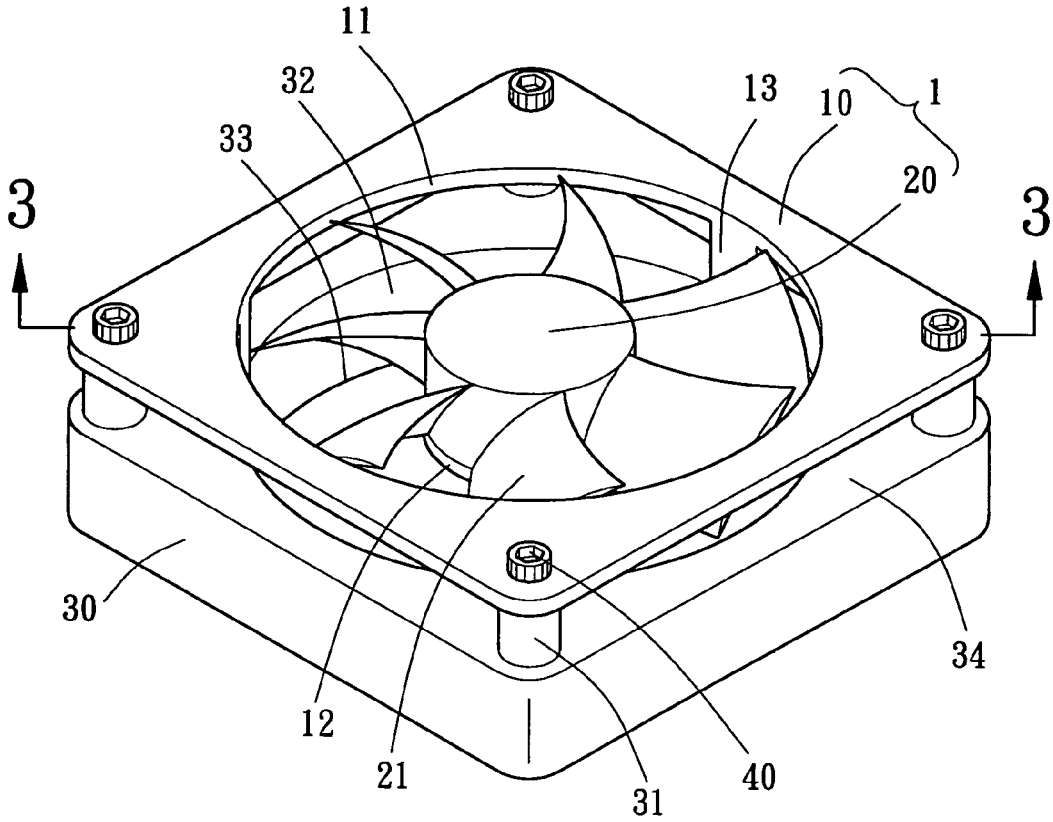
FIG. 2 is a perspective view of the heat dissipating fan in FIG. 1.
Figure 3:
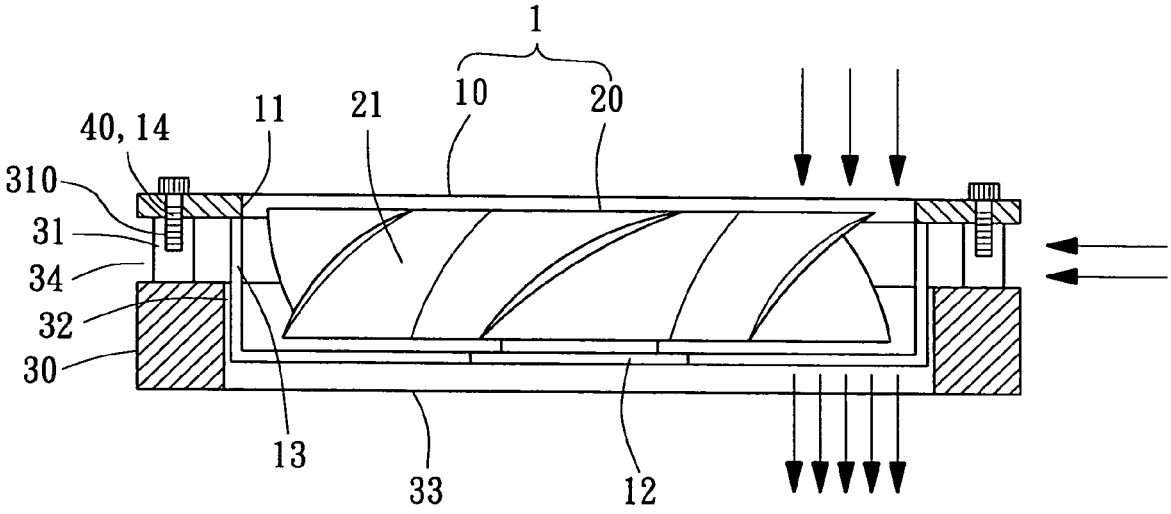
FIG. 3 is a sectional view taken along plane 3-3 in FIG. 2.

Referring to FIGS. 1 through 3, a first embodiment of a heat dissipating fan in accordance with the present invention comprises a cover plate 10, an impeller 20, and an air guiding member 30. The cover plate 10 is made of plastics or metal and includes an air inlet 11 and a base 12 extending in a plane parallel to another plane in which the air inlet 11 lies. A plurality of ribs 13 project from a periphery delimiting the air inlet 11 and connect the base 12, thereby supporting the base 12. The cover plate 10 further includes a first engaging portion 14. In this embodiment, the first engaging portion 14 includes a plurality of through-holes 14.

The impeller 20 is rotatably mounted to an upper side of the base 12 that faces the cover plate 10. The impeller 20 and the cover plate 10 together form a fan unit 1. The impeller 20 includes a plurality of blades 21 on an outer periphery thereof for driving air. The air guiding member 30 is made of plastics or metal and includes a second engaging portion 31, an air passageway 32, an air outlet 33, and a plurality of auxiliary side inlets 34. In this embodiment, the second engaging portion 31 includes a plurality of posts each having a screw hole 310 aligned with the respective through-hole 14 of the cover plate 10. A fastener 40 is extended through the respective through-hole 14 of the cover plate 10 and the respective screw hole 310, thereby fixing the cover plate 10 to the air guiding member 30. As illustrated in FIG. 3, a portion of the axial height of the respective blade 21, as well as a portion of the axial length of the hub portion, of the impeller 20 is received in a first section of the air passageway 32 defined between an air inlet and a middle point of the air guiding member, with a space being defined between the cover plate 10 and the air guiding member 30, forming the side inlets 34 in the fan unit 1, reducing an overall thickness of the combination of the fan unit and the air guiding member 30, and leaving an unobstructed second section of the air passageway 32 of the air guiding member 30 defined between the middle point and an air outlet below the fan unit. The air passageway 32 guides the airflow toward the air outlet 33. The air outlet 33 is oriented in a predetermined direction, e.g., directly below the air guiding member 30. The air guiding member 30 includes an annular sidewall that defines the air passageway 32 between a first end and a second end of the sidewall. The first end of the air guiding member 30 connects to the cover plate 10 in a stacked relationship, and the air guiding member 30 further includes an air outlet proximate to the second end of the air guiding member 30 beyond the fan unit such that the air outlet disposed at the second end can be expanded.

As illustrated in FIG. 3, when the impeller 20 turns, air intake occurs simultaneously in the air inlet 11 and in the side inlets 34 through operation of the blades 21 of the impeller 20. The airflow exits the heat dissipating fan from a position directly below the air guiding member 30, dissipating heat of an object (e.g., a power supply or a casing of a personal computer, not shown) or proceeding with air current exchange. Since additional air is inputted by the impeller 20 via the side inlets 34, the air inlet amount is increased. Further, the air passageway 32 of the air guiding member 30 guides the outgoing air in a predetermined direction; namely, the airflow direction can be guided. The side wall of the air guiding member 30 can confine air in the second section of the air passageway 30 to pass through near regions below the hub portion of the fan unit and then to exit the expanded air outlet in a predetermined direction.

Figure 4:
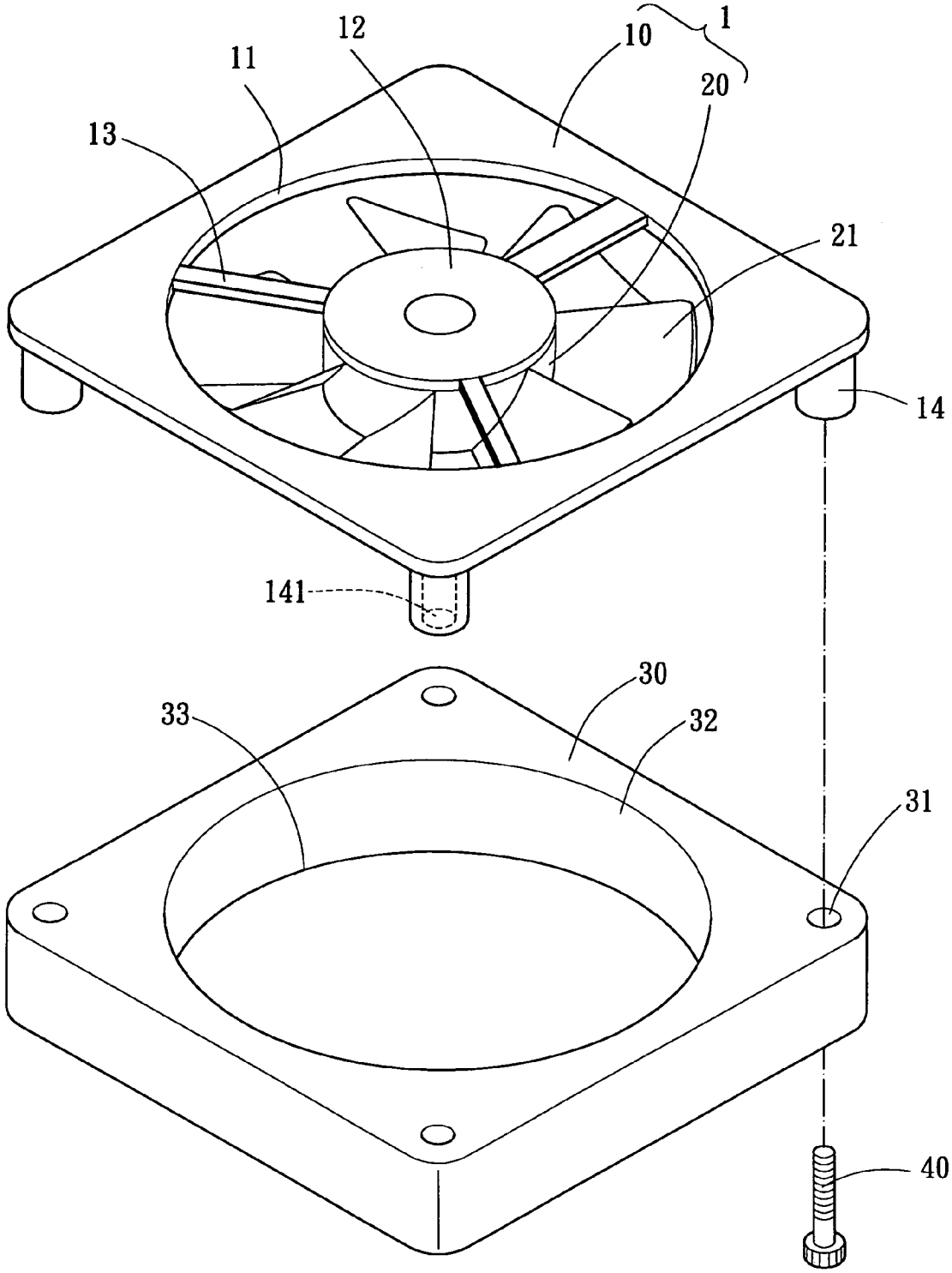
FIG. 4 is an exploded perspective view of a second embodiment of the heat dissipating fan in accordance with the present invention.
Figure 5:
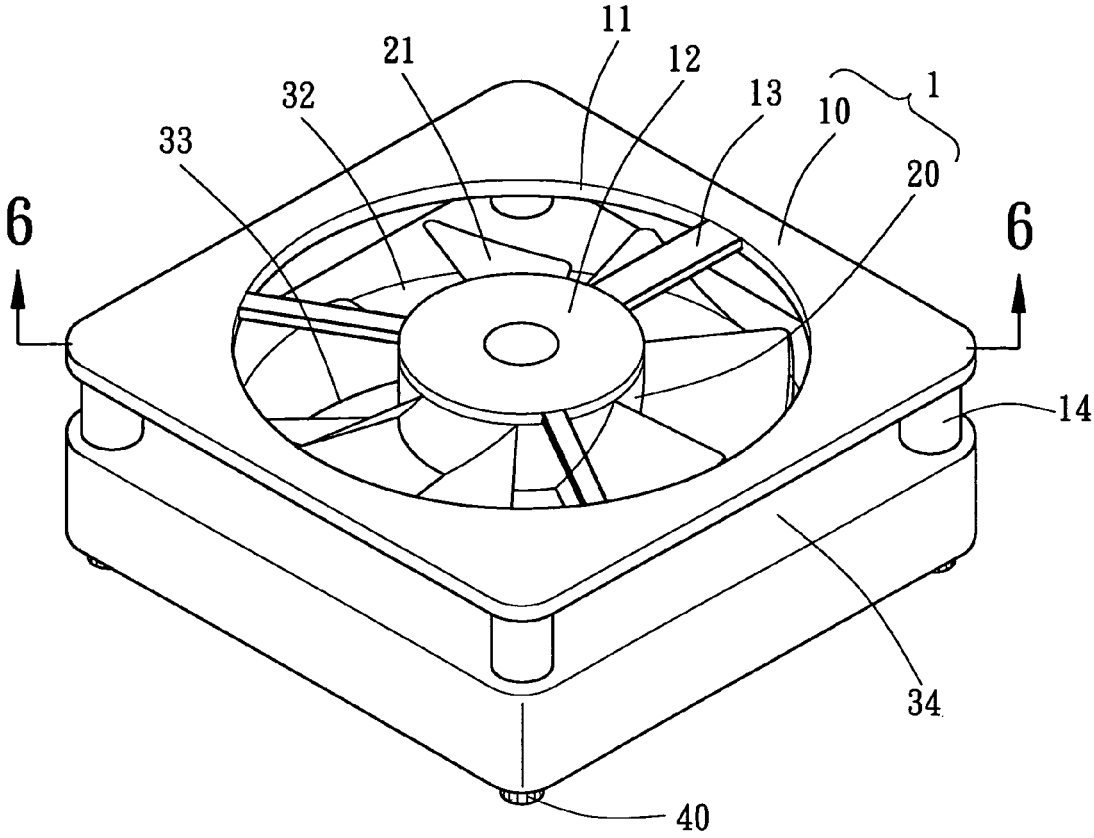
FIG. 5 is a perspective view of the heat dissipating fan in FIG. 4.
Figure 6:
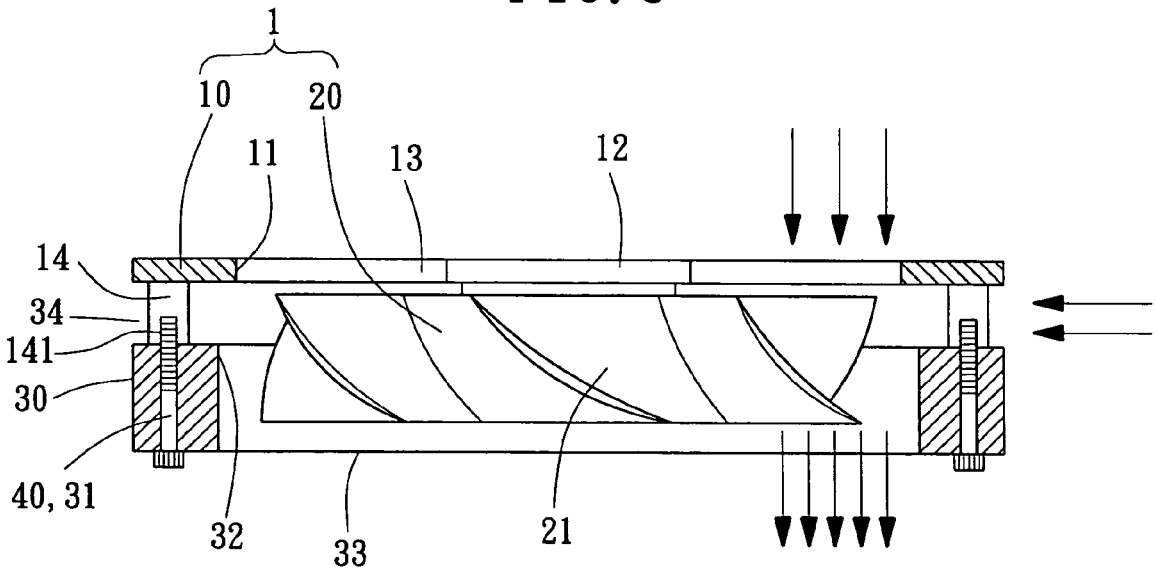
FIG. 6 is a sectional view taken along plane 6-6 in FIG. 5.

FIGS. 4 through 6 illustrate a second embodiment of the heat dissipating fan in accordance with the present invention. In this embodiment, the heat dissipating fan comprises a cover plate 10, an impeller 20, and an air guiding member 30. A plurality of ribs 13 project radially inward from a periphery delimiting an air inlet 11 of the cover plate and connect a base 20 concentrically located in the air inlet 11. Further, the impeller 20 is rotatably mounted to an underside of the base 12. Thus, the impeller 20 and the cover plate 10 together form a suspensory fan unit 1. Further, the first engaging portion 14 of the cover plate 10 includes a plurality of posts having a screw hole 141, and the second engaging portion 31 of the air guiding member 30 includes a plurality of through-holes 31 respectively aligned with the screw holes 141. A fastener 40 is extended through the respective through-hole 31 and the respective screw hole 141. A portion of the axial height of the respective blade 21 of the impeller 20 is received in the air passageway 32, with a space being defined between the cover plate 10 and the air guiding member 30, forming the side inlets 34 in the fan unit 1. The air passageway 32 guides the airflow toward the air outlet 33.

As illustrated in FIG. 6, when the impeller 20 turns, air intake occurs simultaneously in the air inlet 11 and in the side inlets 34 through operation of the blades 21 of the impeller 20. The air passageway 32 of the air guiding member 30 guides the airflow toward a predetermined direction. The air inlet amount is increased, and the airflow direction can be guided. Thus, the heat dissipating efficiency for a to-be-dissipated object located in a predetermined position is improved.

Figure 7:
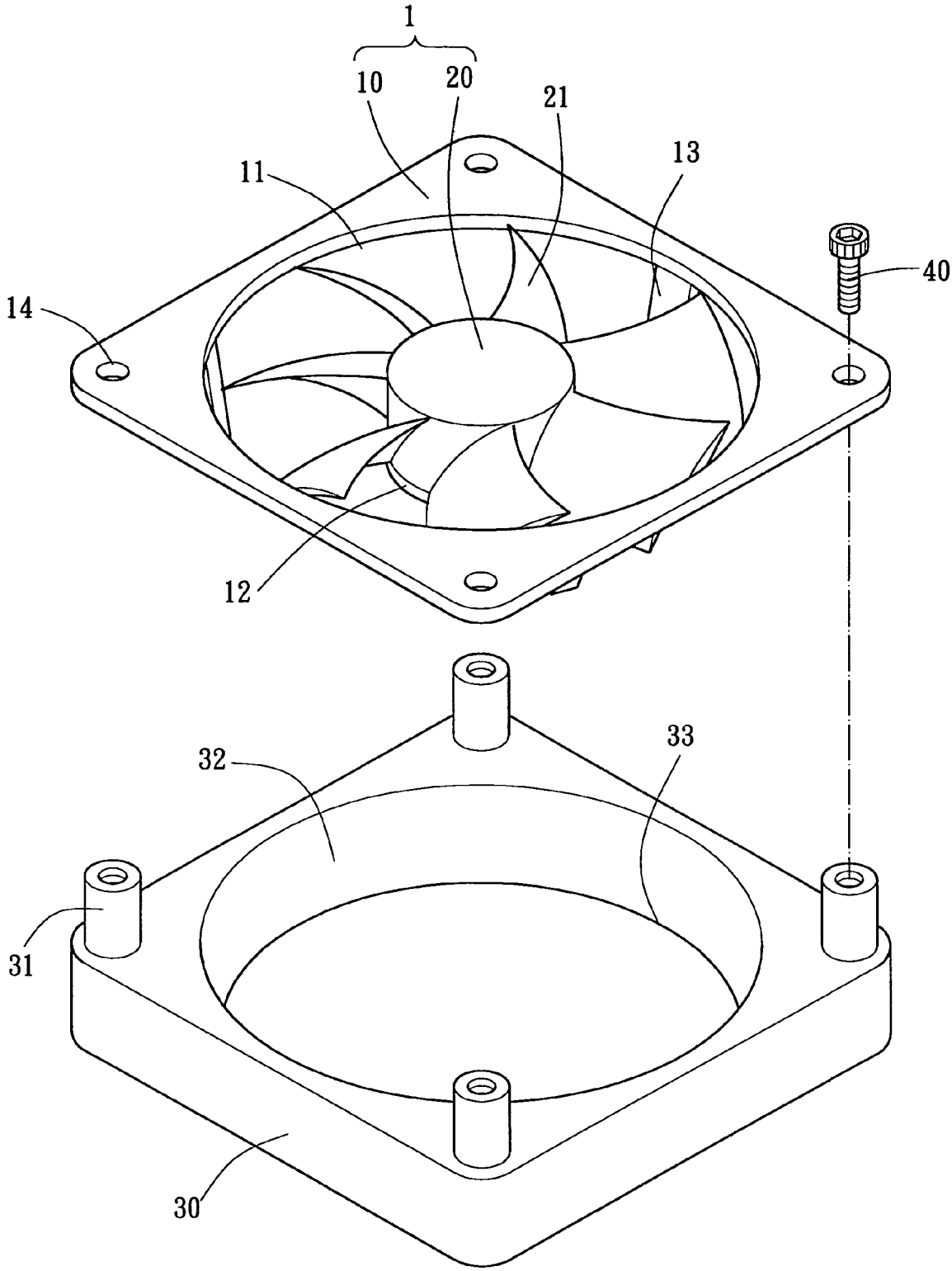
FIG. 7 is an exploded perspective view of a third embodiment of the heat dissipating fan in accordance with the present invention.
Figure 8:
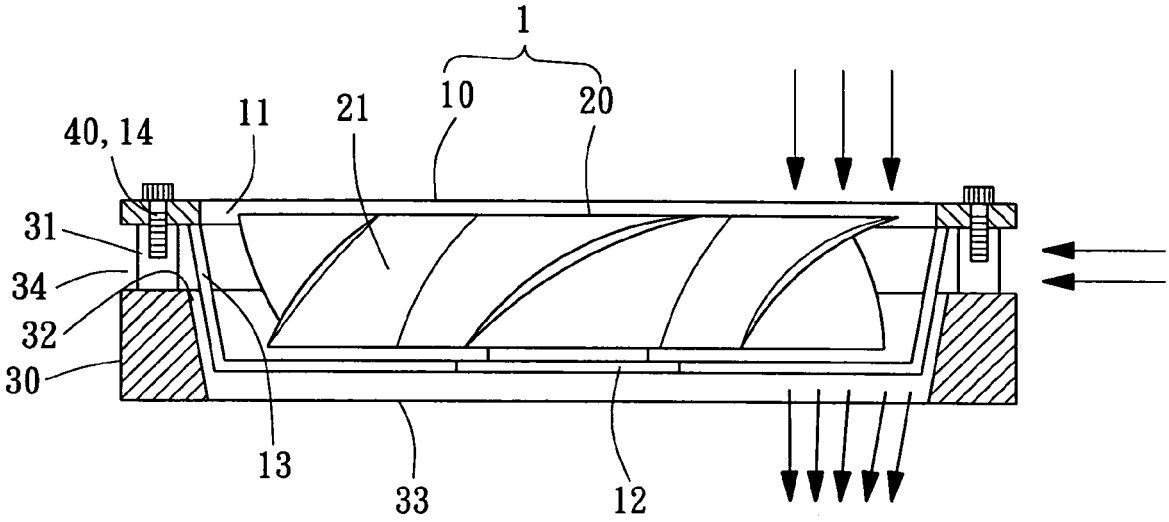
FIG. 8 is a sectional view of the heat dissipating fan in FIG. 7.

FIGS. 7 and 8 illustrate a third embodiment that is modified from the first embodiment. In this embodiment, the air passageway 32 of the air guiding member 30 tapers outward such that a sectional area of an air outlet side of the air passageway 32 is smaller than that of an air inlet side of the air passageway 32. Thus, the airflow is concentrated and the wind pressure of the airflow is thus increased when the airflow passes through the air passageway 32 and exits via the air outlet 34. Further, the fan unit 1 in the first embodiment or the second embodiment can be used with the air guiding member 30 of the third embodiment. Application of the heat dissipating fan is wider and the assembling tolerance is improved.

Figure 9:
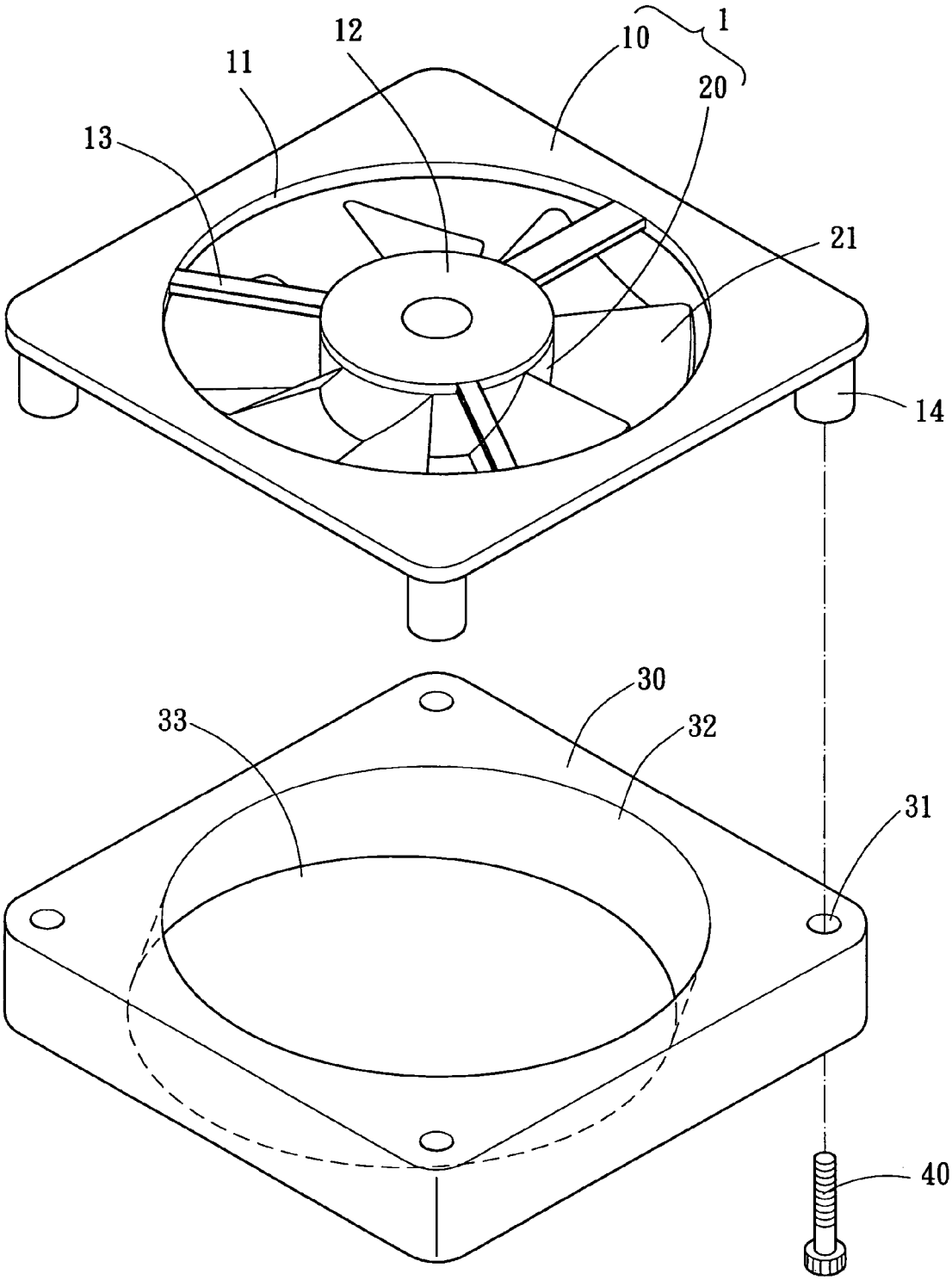
FIG. 9 is an exploded perspective view of a fourth embodiment of the heat dissipating fan in accordance with the present invention.
Figure 10:
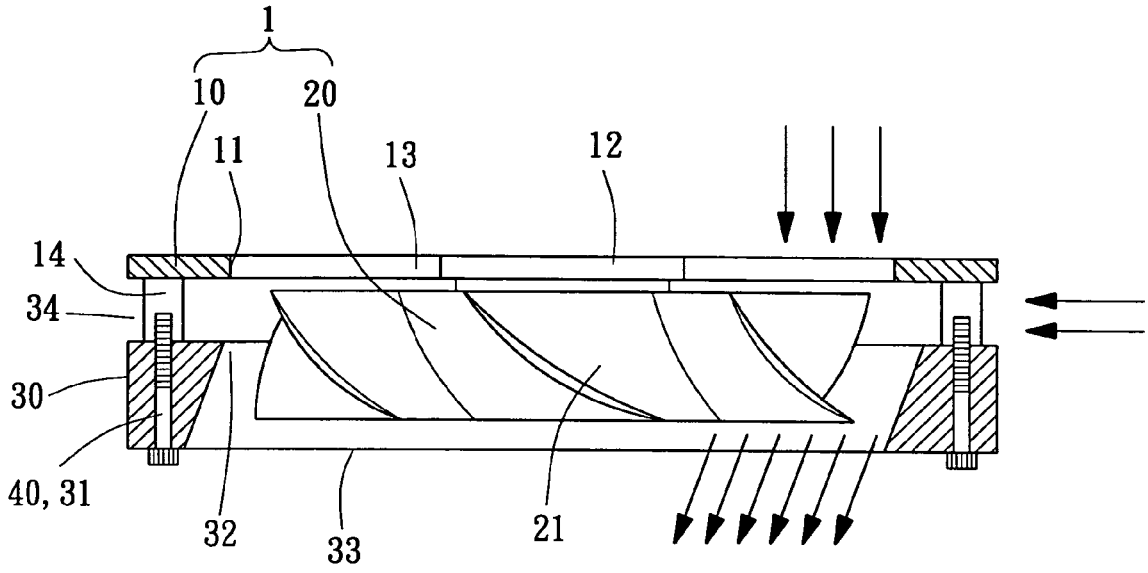
FIG. 10 is a sectional view of the heat dissipating fan in FIG. 9.

FIGS. 9 and 10 illustrate a fourth embodiment that is modified from the second embodiment. In this embodiment, the air passageway 32 of the air guiding member 30 extends in a direction at an angle with an airflow direction along which the air flows. When the impeller 20 turns, air intake occurs simultaneously in the air inlet 11 and in the side inlets 34 through operation of the blades 21 of the impeller 20. The airflow can be guided to an object not directly located below the heat dissipating fan, as the air passageway 32 of the air guiding member 30 may guide the outgoing airflow leftward (see FIG. 10). Further, the fan unit 1 in the first embodiment or the second embodiment can be used with the air guiding member 30 of the fourth embodiment. Application of the heat dissipating fan is wider and the assembling tolerance is improved.

Figure 11:
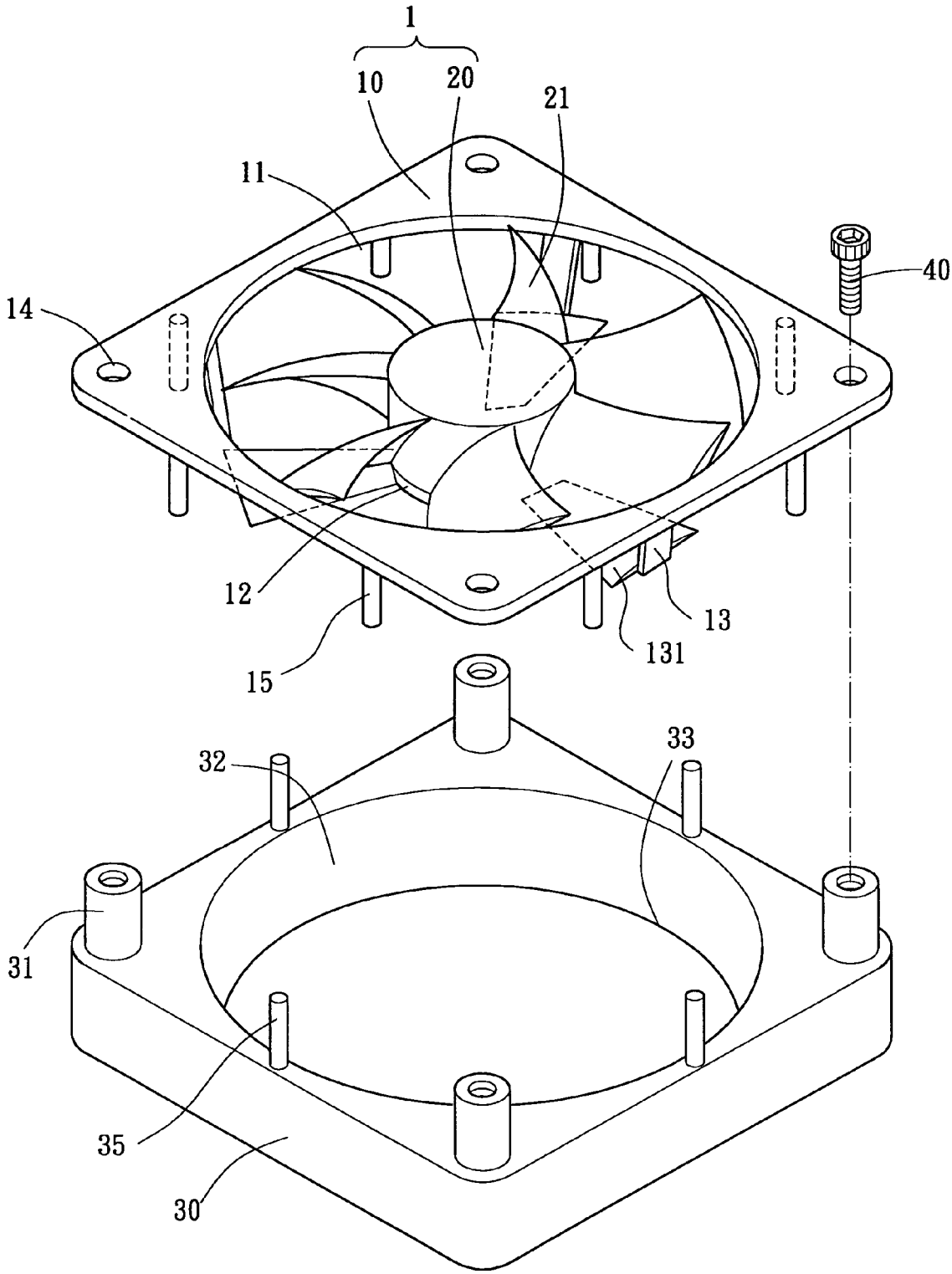
FIG. 11 is an exploded perspective view of a fifth embodiment of the heat dissipating fan in accordance with the present invention.
Figure 12:
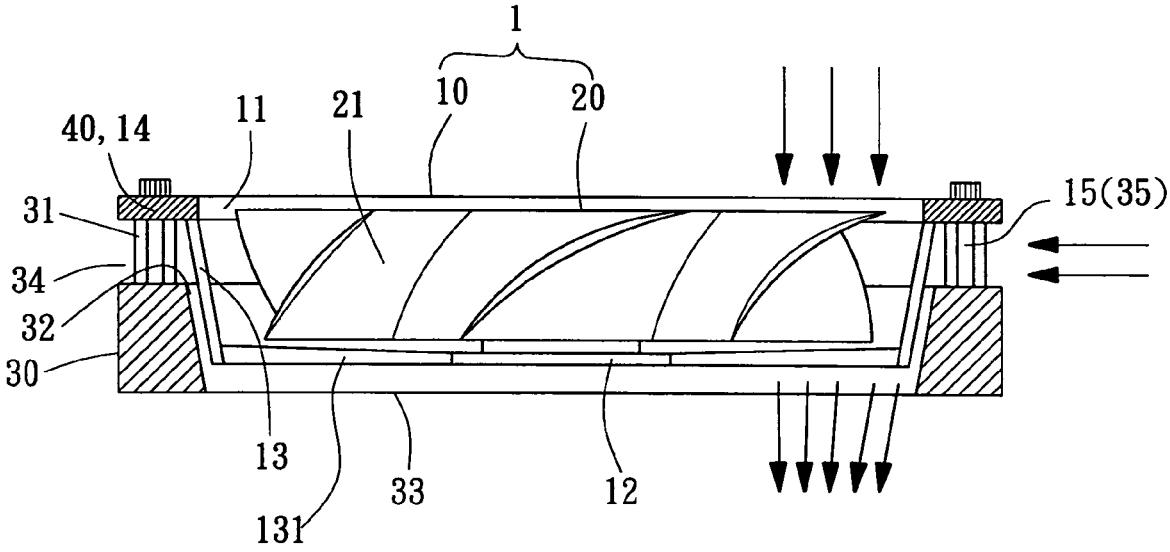
FIG. 12 is a sectional view of the heat dissipating fan in FIG. 11.

FIGS. 11 and 12 illustrate a fifth embodiment modified from the third embodiment. In this embodiment, the cover plate 10 includes a plurality of first posts 15 projecting downward from a peripheral portion of the underside of the cover plate 10, and the air guiding member 30 includes a plurality of second posts 35 projecting upward from a peripheral portion of the upper side of the air guiding member 30. When the cover plate 10 and the air guiding member 30 are assembled, the first and second posts 15 and 35 are located in the respective side inlets 34, preventing the impeller 20 from being impinged, reducing the possibility of entrance of alien objects, and improving the structural strength of the impeller 20. Further, the ribs 13 of the cover plate 10 form a plurality of stationary blades 131 for guiding airflow. The respective stationary blade 131 may include an inclining angle opposite to that of the blades 21. This allows smooth guiding of the airflow and increases the wind pressure.

The size of the side inlets 34, the shapes of the air passageway 32 of the air guiding member 30 and the blades 21 of the impeller 20, and the engaging arrangement between the first and second engaging portions 14 and 31 may vary according to the size, position, shape, and heat dissipating requirement of the object to be dissipated. Thus, the design flexibility and assembling flexibility are improved.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A heat dissipating fan comprising:

a fan-supporting cover plate including an air inlet and a fan-supporting base;

an impeller mounted to an upper side of the fan-supporting base to constitute a fan unit, and the impeller further including a plurality of impeller blades; and an air guiding member including an annular sidewall that defines an air passageway between a first end and a second end of the air guiding member, such that said air guiding member is a single hollow member, there being no part of said air guiding member formed in the air passageway, said first end of the air guiding member connecting to said cover plate in a stacked relationship, and the air guiding member further including an air outlet proximate to said second end of the air guiding member beyond the fan unit such that the air outlet disposed at said second end can be expanded;

a portion of an axial height of said impeller blades being received in a first section of the air passageway of the air guiding member defined between the air inlet and a middle point of the air guiding member and a lower portion of a hub portion of the fan unit received in the first section of the air passageway of the air guiding member so as to reduce an overall thickness of the combination of the fan unit and the air guiding member, and a second section of the air passageway of the air guiding member defined between the middle point and the air outlet of the air guiding member below the fan unit, the air passageway being unobstructed from the fan-supporting base to the air outlet;

a plurality of auxiliary side inlets being defined between the cover plate and the air guiding member, air intake occurring simultaneously in the air inlet and in the auxiliary side inlets when the impeller turns, the side wall confining air in the second section of the air passageway whereby the confined air passes through near regions below the hub portion of the fan unit and then exits the expanded air outlet in a predetermined direction.

2. The heat dissipating fan as claimed in claim 1, wherein the cover plate includes a first engaging portion and the air guiding member includes a second engaging portion engaged with the first engaging portion.

3. The heat dissipating fan as claimed in claim 2, wherein the first engaging portion includes a plurality of through-holes and the second engaging portion includes a plurality of posts each having a screw hole aligned with a respective one of said through-holes.

4. The heating dissipating fan as claimed in claim 2, wherein the second engaging portion includes a plurality of through-holes and the first engaging portion includes a plurality of posts each having a screw hole aligned with a respective one of said through-holes.

5. The heat dissipating fan as claimed in claim 1, wherein a sectional area of an air outlet side of the air passageway is smaller than that of an air inlet side of the air passageway.

6. The heat dissipating fan as claimed in claim 1, wherein the cover plate includes a plurality of posts projecting downward from a peripheral portion of an underside of the cover plate, reducing possibility of entrance of alien objects and improving structural strength of the impeller.

7. The heat dissipating fan as claimed in claim 1, wherein the air guiding member includes a plurality of posts projecting upward from a peripheral portion of an upper side of the air guiding member, reducing possibility of entrance of alien objects and improving structural strength of the impeller.

8. The heat dissipating fan as claimed in claim 1, further including a plurality of ribs connected between the cover plate and the base.

9. The heat dissipating fan as claimed in claim 8, wherein the ribs form a plurality of stationary blades for guiding airflow.

10. The heat dissipating fan as claimed in claim 9, wherein the stationary blades are inclined at an angle opposite to an angle of said impeller blades.

11. A heat dissipating fan comprising:

a fan-supporting cover plate including an air inlet and a fan-supporting base;

an impeller mounted to the fan-supporting base to constitute a fan unit, and the impeller further including a plurality of impeller blades; and an air guiding member including an annular sidewall that defines an air passageway between a first end and a second end of the air guiding member, such that said air guiding member is a single hollow member, there being no part of said air guiding member formed in the air passageway, said first end of the air guiding member connecting to said cover plate in a stacked relationship, and the air guiding member further including an air outlet proximate to said second end of the air guiding member beyond the fan unit such that the air outlet disposed at said second end can be expanded;

a portion of an axial height of said impeller blades being received in a first section of the air passageway of the air guiding member defined between the air inlet and a middle point of the air guiding member and a lower portion of a hub portion of the fan unit received in the first section of the air passageway of the air guiding member so as to reduce an overall thickness of the combination of the fan unit and the air guiding member, and a second section of the air passageway of the air guiding member defined between the middle point and the air outlet of the air guiding member below the fan unit;

a plurality of auxiliary side inlets being defined between the cover plate and the air guiding member, air intake occurring simultaneously in the air inlet and in the auxiliary side inlets when the impeller turns, the side wall confining air in the second section of the air passageway whereby the confined air passes through near regions below the hub portion of the fan unit and then exits the expanded air outlet in a predetermined direction;

wherein the air passageway extends in a direction at an angle with respect to an airflow direction, guiding the airflow to a peripheral side of the air guiding member along the predetermined direction which is mis-aligned with a longitudinal direction of the air guiding member.

12. The heat dissipating fan as claimed in claim 11, wherein the cover plate includes a first engaging portion and the air guiding member includes a second engaging portion engaged with the first engaging portion; and wherein the first engaging portion includes a plurality of through-holes and the second engaging portion includes a plurality of posts each having a screw hole aligned with a respective one of said through-holes; or wherein the second engaging portion includes a plurality of through-holes and the first engaging portion includes a plurality of posts each having a screw hole aligned with a respective one of said through-holes.

13. The heat dissipating fan as claimed in claim 11, wherein the impeller is mounted to an upper or underside side of the base of the cover plate.

14. The heat dissipating fan as claimed in claim 11, wherein a sectional area of an air outlet side of the air passageway is smaller than that of an air inlet side of the air passageway.

15. The heat dissipating fan as claimed in claim 11, wherein the cover plate includes a plurality of posts projecting downward from a peripheral portion of an underside of the cover plate, reducing possibility of entrance of alien objects and improving structural strength of the impeller.

16. The heat dissipating fan as claimed in claim 11, wherein the air guiding member includes a plurality of posts projecting upward from a peripheral portion of an upper side of the air guiding member, reducing possibility of entrance of alien objects and improving structural strength of the impeller.

17. The heat dissipating fan as claimed in claim 11, further including a plurality of ribs connected between the cover plate and the base, said ribs forming a plurality of stationary blades for guiding airflow.

18. The heat dissipating fan as claimed in claim 17, wherein the stationary blade are inclined at an angle opposite to an angle of the blades.

* * * * *